US007537121B2

(12) United States Patent
Markson et al.

(10) Patent No.: US 7,537,121 B2
(45) Date of Patent: May 26, 2009

(54) ACCORDION PRODUCT DISPLAY CONTAINER

(75) Inventors: Rick Markson, Goshen, NY (US); Jay Weinberg, New City, NY (US); Luigi Taranto, Clifton, NJ (US)

(73) Assignee: Sonoco Development, Inc., Hartsville, SC (US)

( * ) Notice: Subject to any disclaimer, the term of this patent is extended or adjusted under 35 U.S.C. 154(b) by 653 days.

(21) Appl. No.: 11/354,865

(22) Filed: Feb. 16, 2006

(65) Prior Publication Data

US 2007/0187289 A1 Aug. 16, 2007

(51) Int. Cl.
*B65D 79/00* (2006.01)

(52) U.S. Cl. ..... 206/745; 206/741; 206/744; 211/72; 40/124

(58) Field of Classification Search ..... 206/490, 206/486, 745, 741, 744, 743, 736, 740; 229/120.01, 229/108.1, 199, 942; 211/72, 73, 52, 55, 211/71.01; 40/124, 124.4, 656
See application file for complete search history.

(56) References Cited

U.S. PATENT DOCUMENTS 1,821,960 A * 9/1931 Brooks, Jr. ..... 206/750
2,110,934 A 3/1938 Kanty
2,135,533 A 11/1938 Ringler
3,286,907 A * 11/1966 Crane ..... 229/117.06
3,369,729 A * 2/1968 Stopper ..... 229/117.06
3,455,498 A * 7/1969 Gadiel ..... 229/117
3,514,031 A * 5/1970 Burgess ..... 229/120.14
3,612,288 A 10/1971 Lesley
3,777,897 A 12/1973 Gray
3,918,576 A 11/1975 Taub
4,022,328 A 5/1977 Toland et al.
4,094,458 A * 6/1978 Nelson, Jr. ..... 229/117
4,311,100 A 1/1982 Gardner et al.
D276,777 S 12/1984 Evenson
4,488,652 A 12/1984 Hinton et al.
4,570,805 A 2/1986 Smith
4,871,218 A 10/1989 Swinson
D314,091 S 1/1991 March
5,016,760 A * 5/1991 Mayo ..... 211/55
5,040,688 A 8/1991 Martin et al.
5,180,058 A 1/1993 Hu
5,255,801 A 10/1993 Berger
5,322,172 A 6/1994 Maglione
D367,678 S * 3/1996 Hart ..... D20/40
5,513,745 A 5/1996 Zoltan et al.
5,630,518 A 5/1997 Collins
5,678,492 A * 10/1997 Pinkstone et al. ..... 108/165
5,826,732 A 10/1998 Ragsdale (Continued)

*Primary Examiner*—David T Fidei
(74) *Attorney, Agent, or Firm*—Clausen Miller, PC

(57) ABSTRACT

An "accordion-like" product display container with a plurality of compartments is provided. The product display container has a collapsed configuration in which the panels are folded up and an expanded display configuration in which the panels form areas for holding product to be displayed. Each compartment in the plurality of compartments further comprises at least one rigidity flap, e.g., a pair of rigidity flaps. The rigidity flaps are deployed into a rigidifying position to stiffen the product display container are resist compression from the expanded display configuration to the collapsed configuration. The display container may be transitioned from the collapsed state to the rigid state solely by deploying the rigidity flaps. The rigidity flaps may be held in place by bottom panels of the compartments.

15 Claims, 9 Drawing Sheets

U.S. PATENT DOCUMENTS

| | | | |
|---|---|---|---|
| 5,899,345 | A | 5/1999 | Fuller et al. |
| 6,109,582 | A | 8/2000 | Repaci et al. |
| 6,427,853 | B2 | 8/2002 | Brozak, Jr. |
| 6,712,227 | B2 | 3/2004 | Blumreich et al. |
| 6,715,623 | B2 | 4/2004 | Broerman |
| D493,289 | S | 7/2004 | Klein et al. |
| 6,910,590 | B2 | 6/2005 | Meier |
| 6,920,985 | B2 | 7/2005 | Chandaria |
| 6,929,132 | B2 | 8/2005 | Belt |
| 6,929,133 | B1 | 8/2005 | Knapp, III et al. |
| 2003/0173318 | A1 | 9/2003 | Rushing |
| 2004/0040921 | A1 | 3/2004 | Chandaria |
| 2004/0200787 | A1 | 10/2004 | Chandaria |
| 2006/0124565 | A1 * | 6/2006 | Speed et al. ..... 211/72 |

* cited by examiner

ACCORDION PRODUCT DISPLAY CONTAINER

TECHNICAL FIELD

The invention generally relates to product display containers.

BACKGROUND

Marketing can be a significant contributor to the success or failure of a product. For example, in the retail industry, the ability to present products and/or samples to consumers in an attractive and/or readily accessible manner can substantially improve sales. Indeed, a great deal of marketing time and effort is often directed toward product display containers in a wide variety of retail environments such as clothing stores, convenience stores, video rental stores, grocery stores, drug stores, trade shows, etc.

Product display containers are often made of a foldable material such as cardboard. Some have a floor-standing configuration with a relatively complicated deployment design. For instance, it is not uncommon for a retail product display to require the manipulation of dozens of folds/creases, perforations and flaps in order to ready the display for use. These complicated deployment designs can result in a time-consuming and labor intensive product display process.

Other approaches to dispensing retail items can involve the use of hanging display containers having multiple compartments. The display container is hung from a hook or clip, and the compartments are loaded with the products to be dispensed. While these displays can be much easier to set up, they often lack stiffness. For example, the display may be required to loaded with product in order to stay in the display position. If the product is removed, the display folds up on itself. This is undesirable as the folded display can be unattractive and can make the retail location appear unkempt. It is also undesirable because it may block view of advertising or other indicia on the display. Moreover, a folded display is more difficult to reload with product.

SUMMARY OF EMBODIMENTS OF THE INVENTION

Certain embodiments of the present invention provide for a product display container comprising a plurality of compartments, each compartment in the plurality of compartments including at least a bottom panel, a front panel, and a back panel. For each compartment, the bottom, front and back panels bound an area, and the area can be collapsed or expanded by folding the panels with respect to each other. To facilitate this action, a fold line extends between the bottom panel and the front panel, and another fold line extends between the bottom panel and the back panel. The product display container has a collapsed configuration in which the bottom panel is approximately parallel to the front and back panels and in which the front panel is proximate the back panel. In this condition, the area bounded by the bottom, front and back panels is collapsed. The product display container has an expanded display configuration in which the front panel is spaced from the back panel and the bottom panel extends between the front and back panels to form an area for holding product to be displayed. The series of panels and fold lines among the plurality of compartments form a pleated configuration resembling an accordion bellows. The product display container is adapted to be moved between the collapsed configuration and the expanded display configuration in an accordion-like manner.

In certain embodiments of the present invention, each compartment in the plurality of compartments further comprises a rigidity flap. The rigidity flap is adapted to be deployed from a non-rigidifying position into a rigidifying position. When the rigidity flap is in the rigidifying position, the rigidifying flap stiffens the product display container to resist compression from the expanded display configuration to the collapsed configuration.

The rigidity flap may be held in the rigidifying position by the bottom panel, for example by an edge of the bottom panel or by an opening in the bottom panel. The rigidity flap may provide stiffness in the rigidifying position by extending between the inner surface of the front panel and the inner surface of the back panel. The rigidity flap may be deployed from the non-rigidifying position into the rigidifying position by folding the rigidity flap at a fold line.

Each compartment in the plurality of compartments may have two or more rigidity flaps. Each compartment in the plurality of compartments may have a top panel having two top panel sections, with a rigidity flap extending from and foldable with respect to each of the two top panel sections.

The front panel may include a front compartment opening to facilitate access to a plurality of products disposed within the compartment. The back panel of one compartment may be coupled to a front panel of an adjacent compartment. The product display container may include a mounting mechanism coupled to an uppermost one of the plurality of compartments to enable the product display container to be hung. Certain embodiments of the present invention provide for a product display container comprising at least one compartment similar to the compartments described above.

Certain embodiments of the present invention provide for a method of providing a product display container with resistance to collapse. The method comprises deploying a rigidity flap from a non-rigidifying position into a rigidifying position, wherein, when the rigidity flap is in the rigidifying position, the rigidity flap stiffens the product display container to resist compression from the expanded display configuration to the collapsed configuration.

Further embodiments, features and aspects of the present invention will become readily ascertainable from the following discussion and are set forth in the appended claims.

BRIEF DESCRIPTION OF THE DRAWINGS

The foregoing and further features and advantages of the invention will become apparent from the following description of embodiments with reference to the accompanying drawings, wherein like numerals are used to represent like elements and wherein.

DETAILED DESCRIPTION

Certain embodiments of the present invention provide an accordion-like product display container using a unique flap configuration to provide increased rigidity and resist collapse. As used herein, the term "accordion-like" means that the display has a first end and a second end and a series of alternating fold lines in between, such that, when the first end and second end are brought closer together, the display compresses to a collapsed configuration, and, when the first end and second end are brought farther apart, the display expands to a display configuration.

Figure 1:
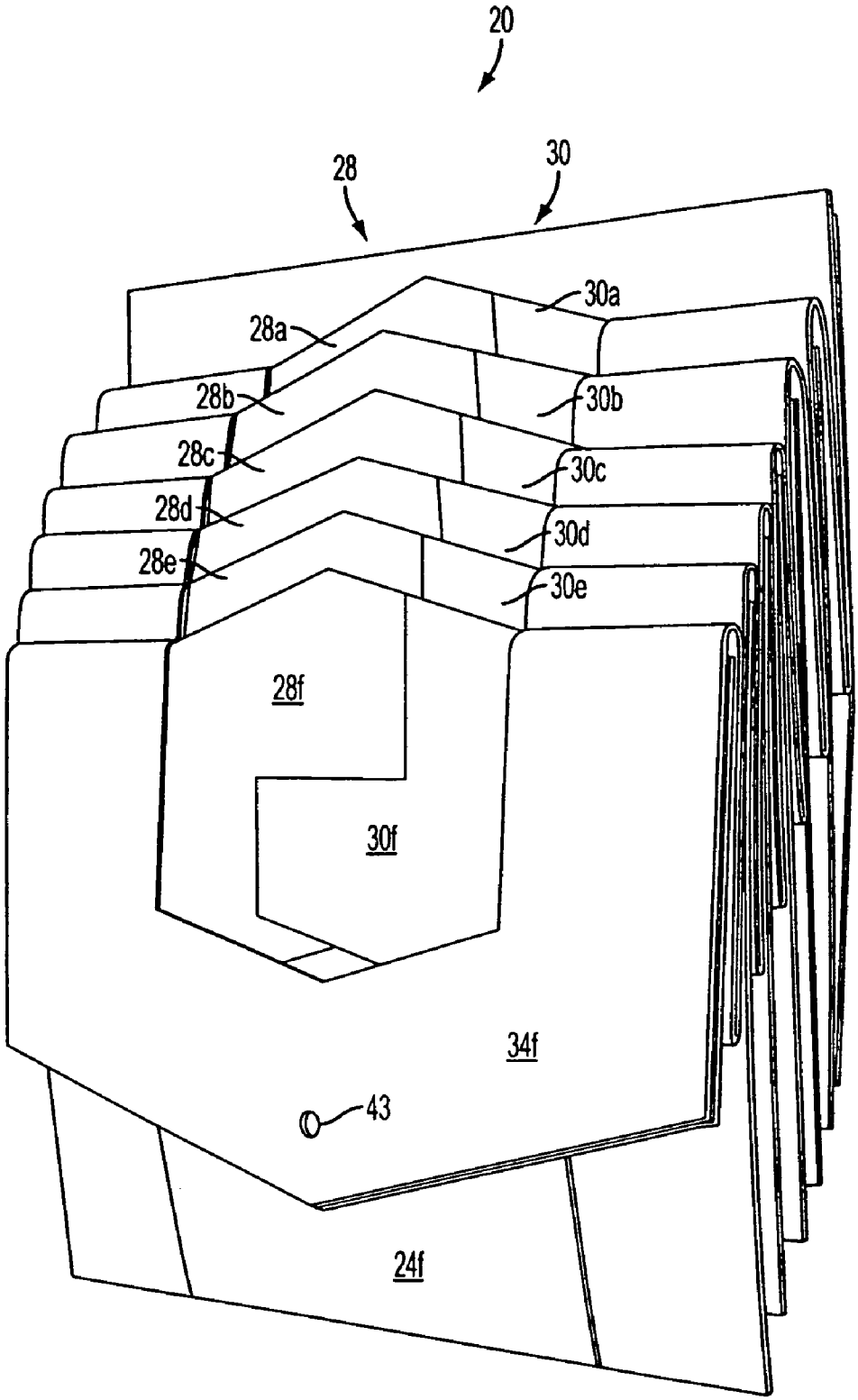
FIG. 1 is a perspective view of an example of a product display container in a collapsed state according to an embodiment of the invention.

FIG. 1 shows an accordion-like product display container 20 in a collapsed configuration. The display container 20 may be constructed of cardboard, paper board, plastic, etc., any combination thereof, or any other suitable material. The display container 20 can be used for a variety of purposes. For example, it may be used permanently or temporarily in a "point of purchase" (POP) environment to display a wide variety of items, for example candy, shoes, tobacco products, batteries, video cassettes, DVD's, and so on.

When in the collapsed state, the illustrated display container 20 has a relatively small overall volume and can be packed into tight shipping configurations. As will be discussed in greater detail, the display container 20 illustrated in this embodiment has pairs of rigidity flaps 28, 30 (28*a*-28*f*, 30*a*-30*f*) that substantially increase the rigidity of the display container 20 when deployed and make it more resistant to collapse. It can be seen that, in this embodiment, each pair of rigidity flaps 28, 30 has a mating shape that enables the rigidity flaps to be collapsed as tightly as possible.

Figure 2:
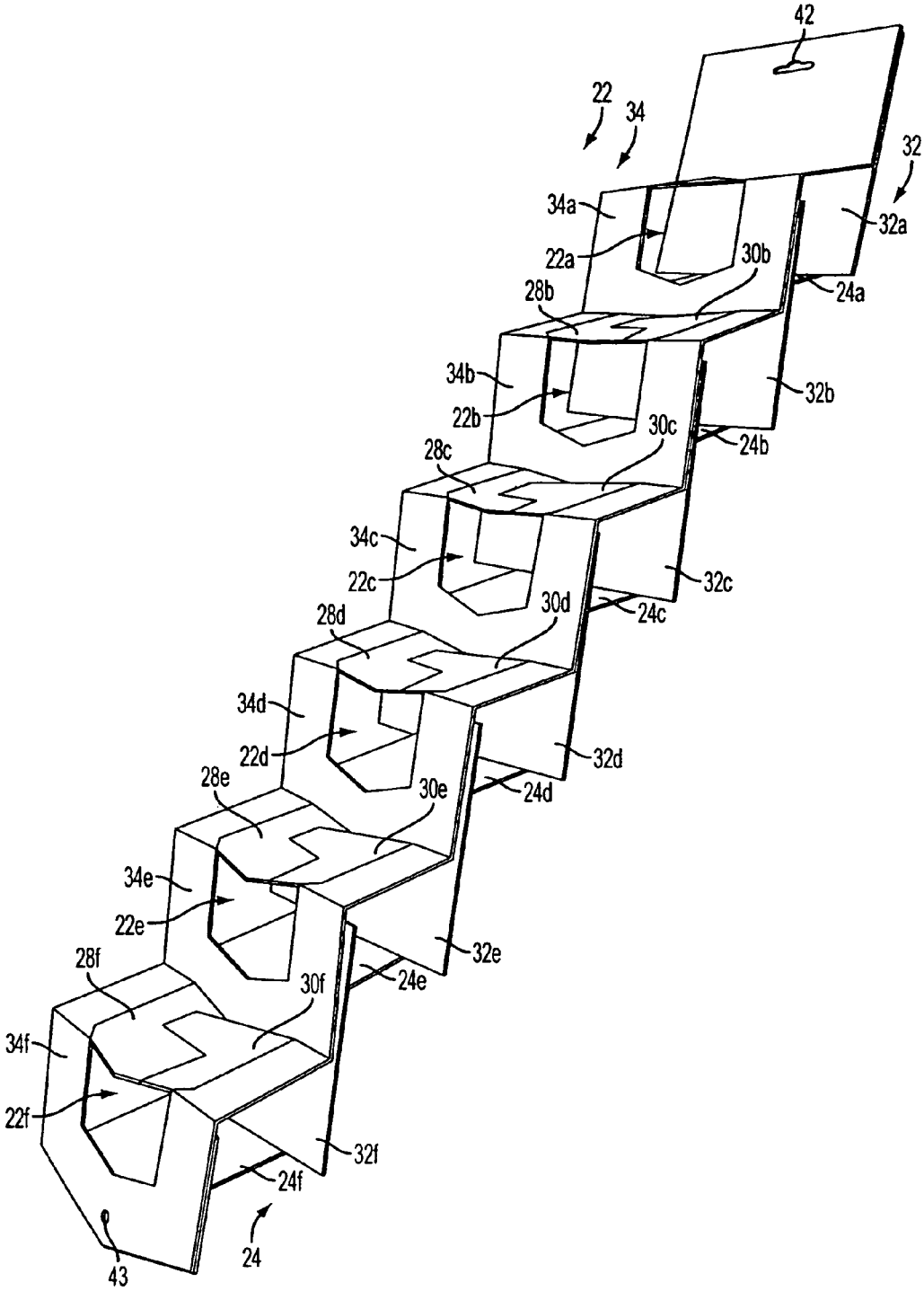
FIG. 2 is a perspective view of an example of a partially deployed product display container according to an embodiment of the invention.

FIG. 2 shows the display container 20 in a partially deployed state (i.e., after the display container has been expanded but before the rigidity flaps 28, 30 have been folded down). As can be seen in this view, the display container 20 has a plurality of compartments 22 (22*a*-22*f*), wherein each compartment 22 includes a bottom panel 24 (24*a*-24*f*), a front panel 34 (34*a*-34*f*), a back panel 32 (32*a*-32*f*), and a plurality of rigidity flaps 28 (28*a*-28*f*) and 30 (30*a*-30*f*). For example, the illustrated compartment 22*a* has a bottom panel 24*a*, a front panel 34*a*, a back panel 32*a*, and a pair of rigidity flaps 28*a*, 30*a* (FIG. 3); the illustrated compartment 22*b* has a bottom panel 24*b*, a front panel 34*b*, a back panel 32*b*, and a pair or rigidity flaps 28*b*, 30*b*; and so on. In this illustrated embodiment, the back panel of one compartment is coupled to a front panel of an adjacent compartment. For each compartment 22, the bottom panel 24 is foldably coupled to the front panel 34 at a bottom-front fold line between the bottom panel and the front panel, and the bottom panel 24 is foldably coupled to the back panel 32 at a bottom-back fold line between the bottom panel and the back panel. As shown in FIGS. 1 and 2, these panels and fold lines give the display container an "accordion-like" configuration that can be expanded and collapsed.

Figure 3:
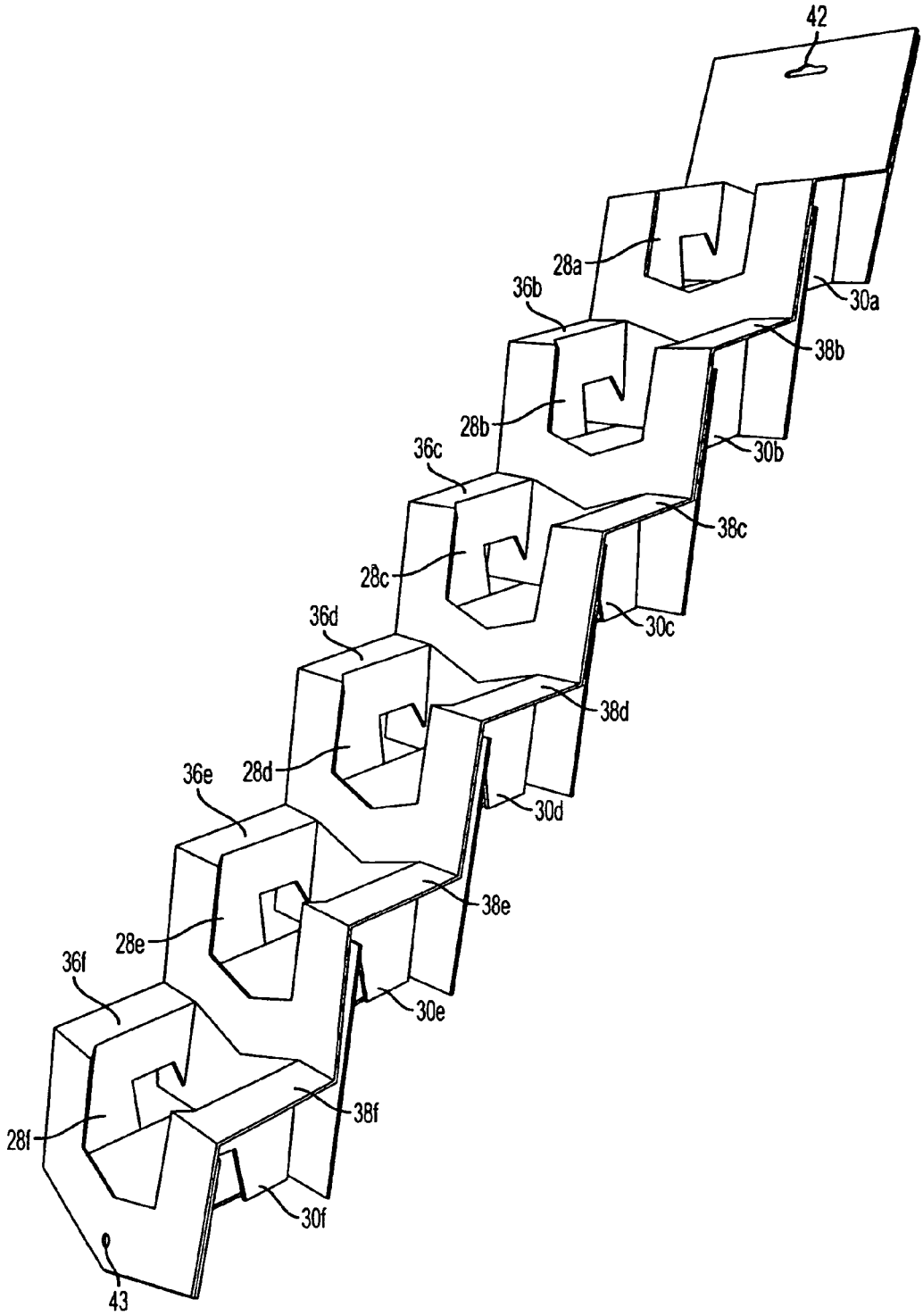
FIG. 3 is a perspective view of an example of a product display container in a rigid state according to an embodiment of the invention.

Turning now to FIG. 3, the display container 20 is shown in the fully expanded and rigid state. In particular, each compartment 22 has been transitioned into the rigid state by deploying the corresponding pair of rigidity flaps 28, 30 from the non-rigidifying position shown in FIG. 2 into the rigidifying position shown in FIG. 3. For example, compartment 22*a* is transitioned into the rigid state by simply folding down rigidity flaps 28*a* and 30*a* into contact with bottom panel 24*a*, compartment 22*b* is transitioned into the rigid state by folding down rigidity flaps 28*b* and 30*b* into contact with bottom panel 24*b*, and so on. By limiting the deployment requirements to manipulation of the rigidity flaps 28, 30 (i.e., in this embodiment, by folding them about respective fold lines), the illustrated display container 20 is relatively easy to expand to a condition in which it is resistant to collapse. As a result, deployment labor time and/or costs can be minimized.

As can be seen in FIGS. 1-3, when the product display container 20 is in the collapsed configuration (FIG. 1), the bottom panels 24 are approximately parallel to the front and back panels 34, 32, and, for each compartment, the front panel 34 is proximate the respective back panel 32. When the product display container 20 is in the expanded display configuration (FIG. 3), for each compartment, the front panel 34 spaced from the respective back panel 32, and the bottom panel 24 extends between the front and back panels 34, 32, thereby forming an area for holding product to be displayed.

With continuing reference to the embodiment illustrated in FIGS. 1-3, the rigidity flaps 28, 30 enhance the structural rigidity of the display container 20 by resisting compression of the display container 20 from the expanded display configuration shown in FIG. 3 into the collapsed configuration shown in FIG. 1. In each compartment, the rigidity flaps 28, 30 extend between the front panel 34 and the respective back panel 32, thereby keeping them spaced apart and preventing them from moving toward each other. For example, with reference to FIG. 3, the front panels 34 have inner surfaces which face the area for holding product, the back panels 32 also have inner surfaces which face the area for holding product, and, in each compartment, the rigidity flaps 28, 30 extend between the inner surface of the front panel 34 and the inner surface of the back panel 32. In particular, the inner surface of the front panel 34 abuts against an edge of each rigidity flap 28, 30, and the inner surface of the back panel 32 abuts against another edge of each rigidity flap 28, 30. For example, the front edge of the rigidity flap 28*a* is configured to abut against the inner surface of the front panel 34*a* when the compartment 22*a* is in the rigid state, and the back edge of the rigidity flap 28*a* is configured to abut against the inner surface of the back panel 32*a* when the compartment 22*a* is in the rigid state. Similarly, the front edge of the rigidity flap 30*a* is configured to abut against the inner surface of the front panel 34*a* when the compartment 22*a* is in the rigid state, and the back edge of the rigidity flap 30*a* is configured to abut against the inner surface of the back panel 32*a* when the compartment 22*a* is in the rigid state.

The product display container 20 may be designed such that the rigidity flaps 28, 30 are held or locked in the rigidifying position to prevent them from unintentionally slipping out of the rigidifying position. For example, the rigidity flaps 28, 30 may be held in the rigidifying position by the bottom panel 24. In the embodiment illustrated in FIGS. 1-3, the rigidity flaps 28, 30 are held in the rigidifying position by an edge of the bottom panel 24. For example, the rigidity flap 28*a* of the compartment 22*a* has a surface that is configured to be biased against a left edge of the bottom panel 24*a* when the compartment 22*a* is in the rigid state. Similarly, the rigidity flap 30*a* of the compartment 22*a* has a surface that is configured to be biased against the right edge of the bottom panel 24*a* when the compartment 22*a* is in the rigid state. When deploying the rigidity flaps 28, 30, they are folded far enough so that they pass the respective edges of the bottom panel 24 and thereby lock into place. The respective edges of the bottom panel 24 prevent the rigidity flaps 28, 30 from unfolding back into their original positions unless a sufficient force is acted on them, such as by a person intending to collapse the display.

In the embodiment of FIGS. 1-3, each compartment 22 has a top panel comprised of two top panel sections 36 (36*a*-36*f*), 38 (38*a*-38*f*) extending between the front panel 34 and the back panel 32. In this embodiment, the pairs of rigidity flaps 28, 30 are foldably coupled to the pairs of top panel sections 36,38. This folding relationship, which can be achieved via a conventional fold line or crease or other suitable technique, can provide the necessary spring force to bias the rigidity flaps 28, 30 against the edges of the bottom panel 24.

Figure 4:
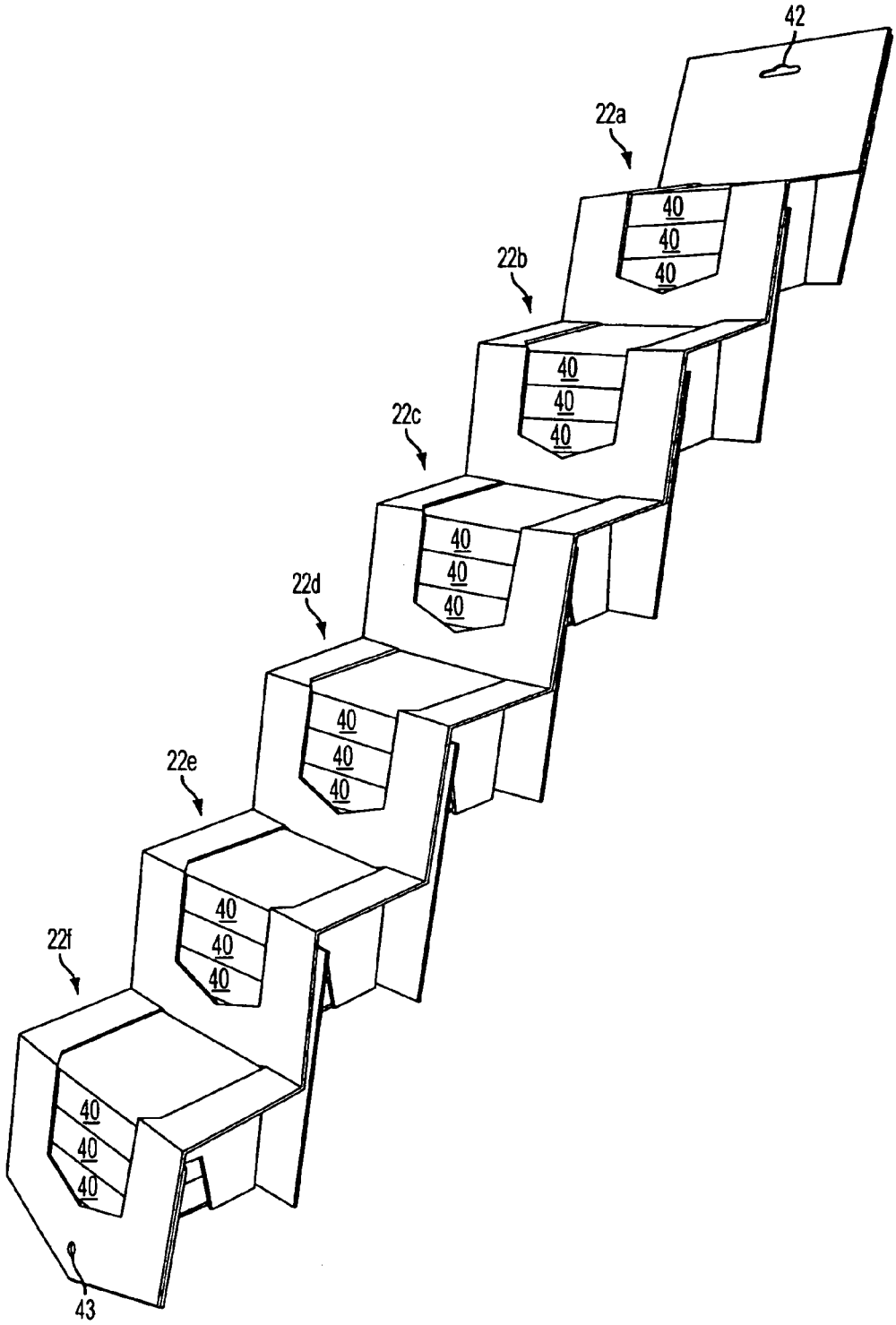
FIG. 4 is a perspective view of an example of a product display container containing items for dispensing according to an embodiment of the invention.

FIG. 4 illustrates that once the display container 20 is fully expanded, products 40 can be loaded into the compartments 22 for display, dispensing and/or sale. As already noted, the products 40 may represent containers of various items such as candy, cosmetics, personal care products, tobacco products, batteries, videos and so on. In this regard, each front panel 34 can include an opening to facilitate access to the products 40 disposed within the compartments 22. In the illustrated example, the compartment openings have tapered bottoms, which may make it easier to access products near the bottom of the compartments 22 as the compartments are emptied. Alternatively, the products 40 may be arranged in a vertical fashion so that they sit side-by-side in the compartments 22, or in any other suitable manner.

The illustrated display container 20 also includes a mounting mechanism coupled to the uppermost compartment 22*a* to enable the display container 20 to be hung on a vertical surface such as a wall, pole or post. In particular, the illustrated mounting mechanism includes a hanging aperture 42 disposed within the back panel 32*a* of the compartment 22*a*. Thus, the display container 20 can be hung on a hook, attached to a clip, or hung by any other suitable structure. Other examples of mounting mechanisms could include hooks, adhesives, clips, etc., coupled to the rear surface of the back panel 32*a*. Advertising or other indicia may be printed on the various parts of the display container 20, as appropriate. A hole 43 at the bottom of the display container 20 enables the retailer to attach (e.g., via S-hook) one display container to the bottom of another, which can provide for the display of additional product where space is available.

It will be appreciated that a display as described can be held in the display configuration by its own construction and does not need to be loaded with product in order to stay in the display configuration. If the product is removed, the display does not fold up on itself. Thus, the display does not appear unattractive or block view of advertising or other indicia on the display. Moreover, the display is easy to reload with product, because the areas for holding product maintain their shape even when empty.

Figure 5:
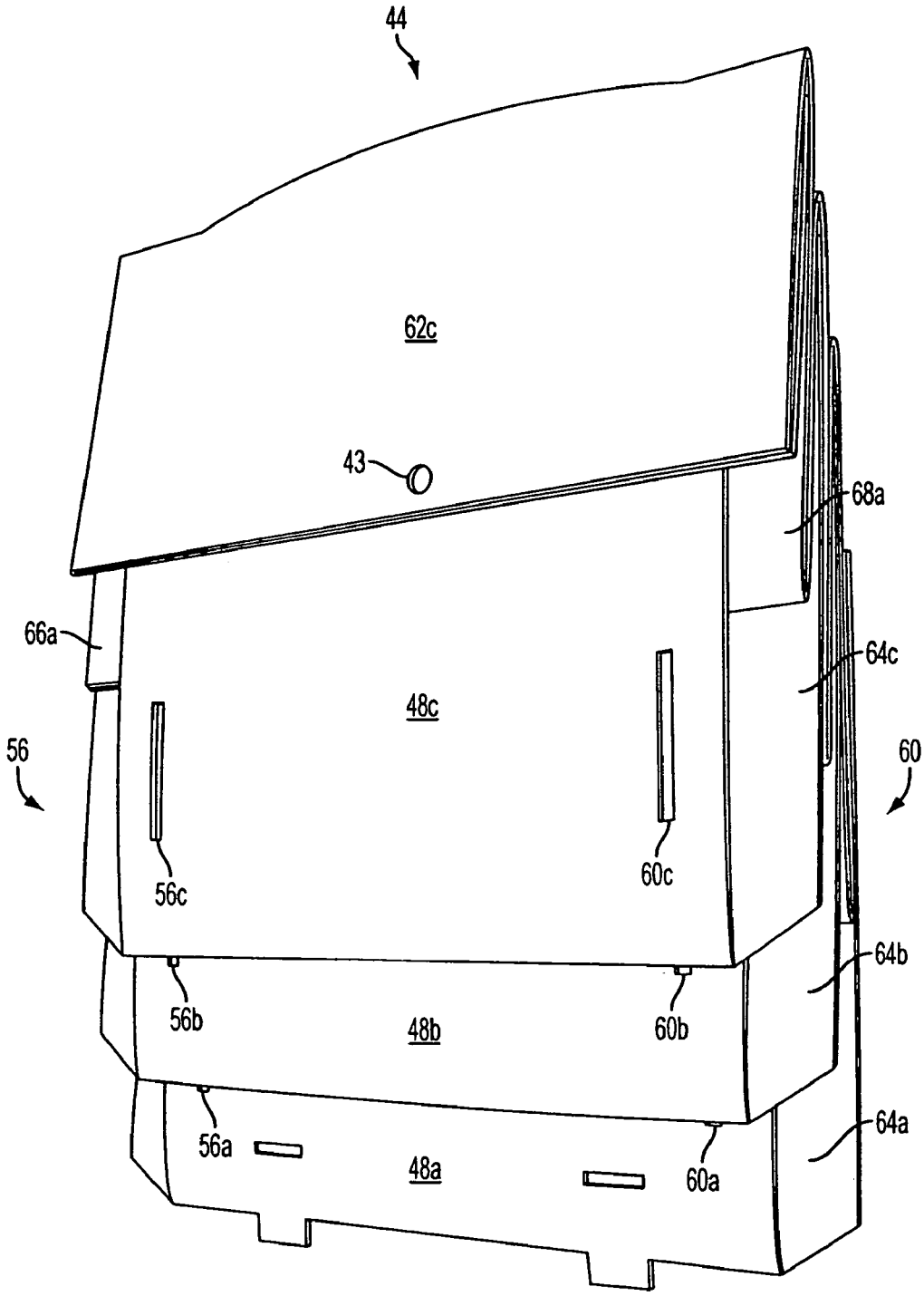
FIG. 5 is a perspective view of an example of a product display container in a collapsed state according to a second embodiment of the invention.
Figure 6:
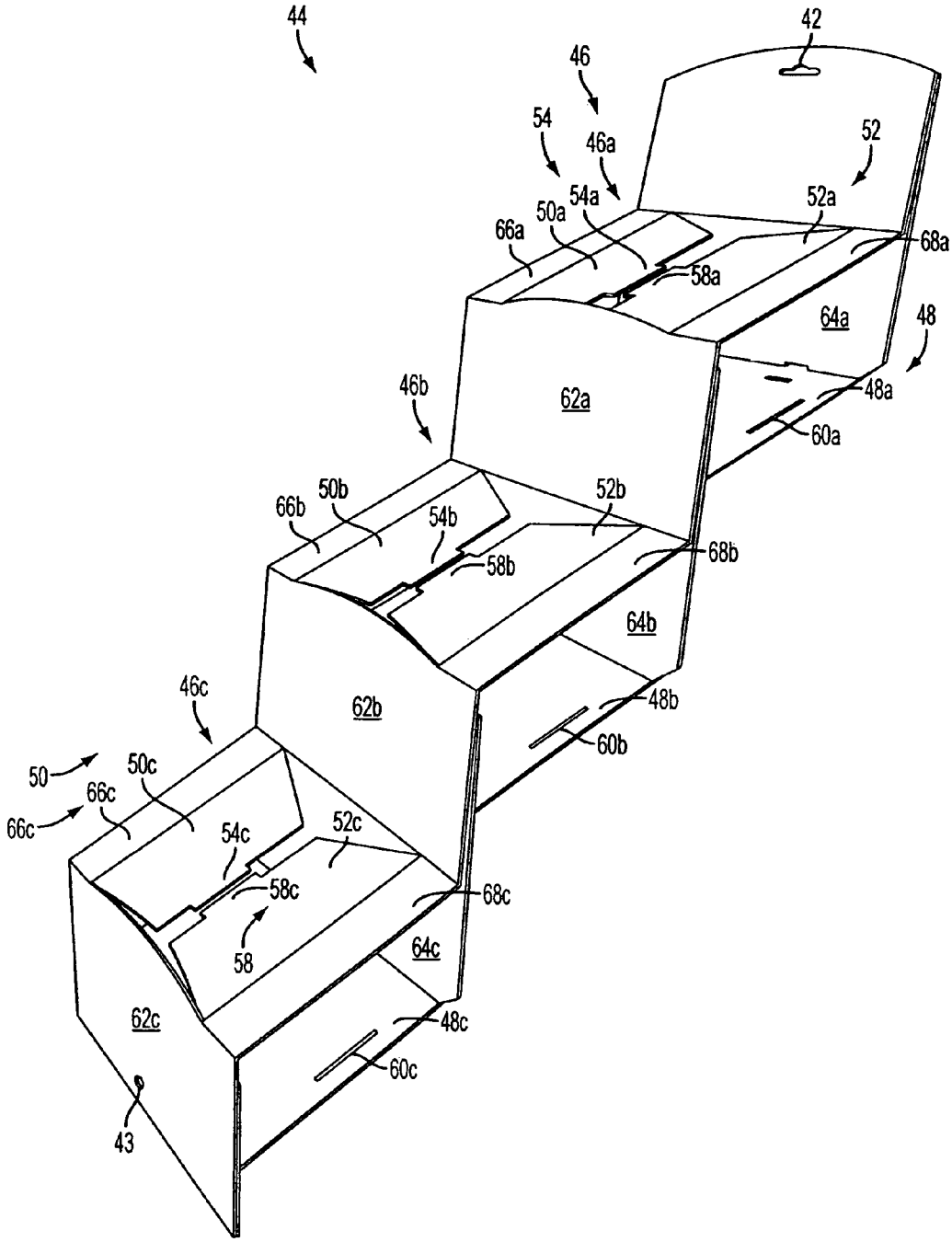
FIG. 6 is a perspective view of an example of a partially deployed product display container according to a second embodiment of the invention.

Turning now to FIG. 5, an alternative display container 44 is shown. In the illustrated example, the display container 44 is shown in the collapsed state. As in the previous example, the display container 44 may be constructed of cardboard, paper board, plastic, or any other suitable material, and may be used to display and/or dispense a wide variety of items. When in the collapsed configuration, the display container 44 has a relatively small overall volume and can be packed into tight shipping configurations or can be shipped set up with product in place as a pre-pack. As will be discussed in greater detail below, the illustrated display container 44 may be configured to contain larger, bulkier and/or heavier products than the display container 20 (FIGS. 1-4) already discussed.

With continuing reference to FIGS. 5-8, the display container 44 has a plurality of compartments 46 (46*a*-46*c*). In the illustrated example, the display container 44 has three compartments. The display container 44 may have more compartments than the number shown or fewer compartments than the number shown, depending upon the circumstances. Each compartment 46 includes a bottom panel 48 (48*a*-48*c*), a front panel 62 (62*a*-62*c*), a back panel 64 (64*a*-64*c*), and a plurality of rigidity flaps 50 (50*a*-50*c*) and 52 (52*a*-52*c*). As in the embodiment discussed above, each compartment 46 is configured to be transitioned from the collapsed configuration to the rigid configuration by deploying the corresponding pair of rigidity flaps 50, 52. For example, deploying the rigidity flaps 50*a*, 52*a*, places the compartment 46*a* in a rigid state. The same is true for the other compartments of the display container 44.

Figure 7:
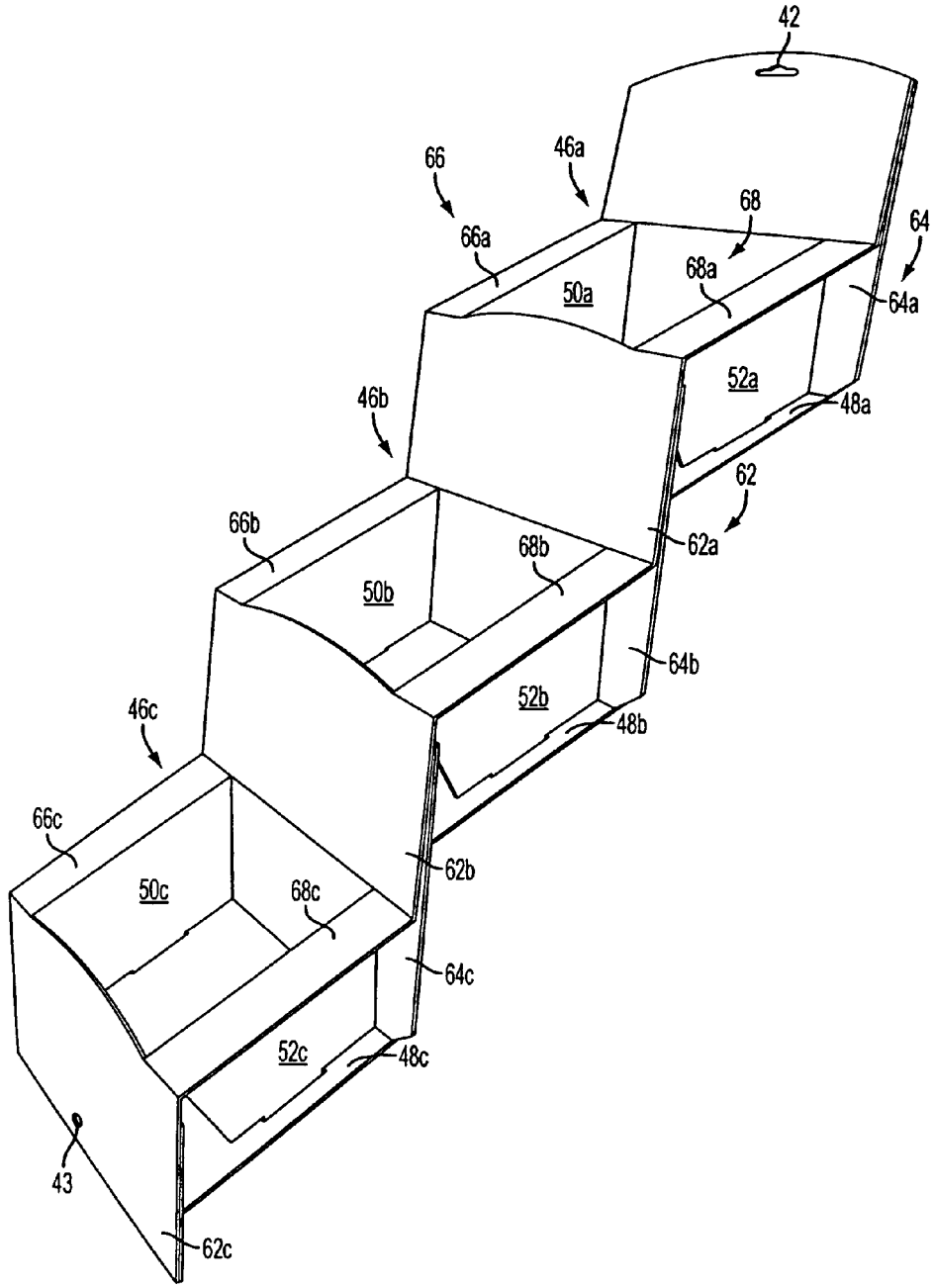
FIG. 7 is a perspective view of an example of a product display container in a rigid state according to a second embodiment of the invention.

In this particular example, the left rigidity flap 50*a* of the compartment 46*a* has a tab 54*a* that is configured to be inserted into an opening 56*a* (FIG. 5) in the bottom panel 48*a* when the compartment 46*a* is in the rigid state. Similarly, the right rigidity flap 52*a* of the compartment 46*a* has a tab 58*a* that is configured to be inserted into an opening 60*a* in the bottom panel 48*a* when the compartment 46*a* is in the rigid state. The tabs 54, 58 (54*a*-54*c*, 58*a*-58*c*) and the openings 56, 60 (56*a*-56*c*, 60*a*-60*c*), therefore function to "lock" the individual compartments 46 into the rigid expanded display configuration as shown in FIG. 7.

With continuing reference to FIGS. 5-8, it can be seen that each compartment 46 may also include a top panel comprising a pair of top panel sections 66 (66*a*-66*c*) and 68 (68*a*-68*c*) extending between the front panels 62 and the back panels 64, where the pairs of rigidity flaps 50, 52 are foldably coupled to the pairs of top panel sections 66, 68. The front panels 62, back panels 64 and top panel sections 66, 68 may be used to display advertising or other indicia.

Figure 8:
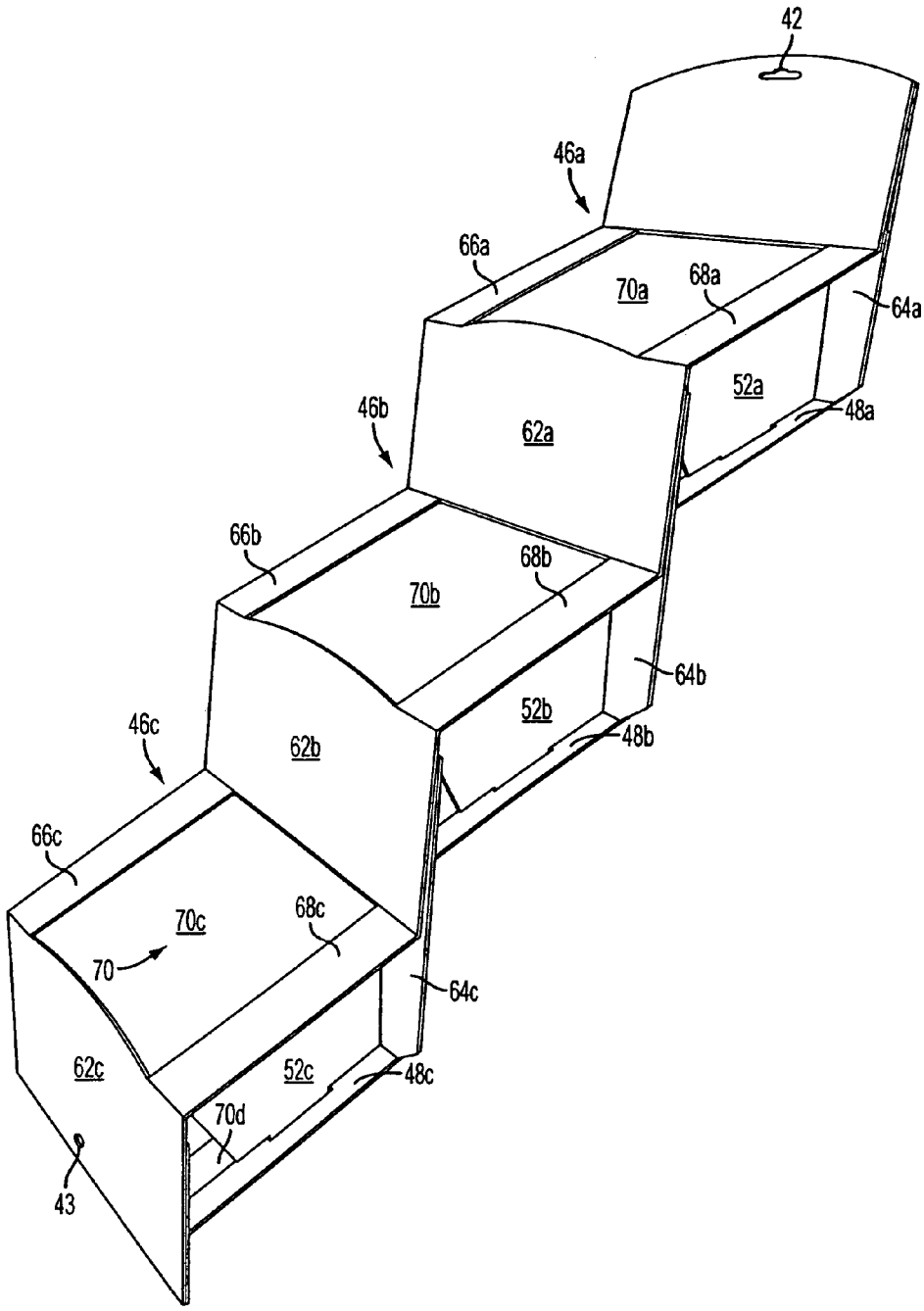
FIG. 8 is a perspective view of an example of a product display container containing items for dispensing according to a second embodiment of the invention.

FIG. 8 shows that once the display container 44 is fully expanded, products 70 (70*a*-70*d*) can be loaded into the compartments 46 for display, dispensing and/or sale. In the illustrated example, the front panels 62 do not have compartment openings. This may be the case when, due to the nature of the product, it is needed to insure that the products 70 remain within the compartment 46 (i.e., do not slip out) when the display container 44 is in use. The lack of a compartment opening may also increase the available surface area for printing messages. The display container 44 may also include a mounting mechanism such as the hanging aperture (FIGS. 2-4), already discussed. The products 70, which may alternatively be arranged vertically or otherwise within the compartment 46, may include any type of item, retail or otherwise. Examples of the products 70 include, but are not limited to, video packages, chewing gum packages, beverages, stationery products, hair care products, books, clothing items, and so on. The simplified mechanism for deploying the display container 44 can reduce setup time and labor costs, and may reduce the overall time to market for a particular product. Furthermore, the structurally solid flap configuration enables the display container 44 to be used in a wider variety of environments. In addition, the ability to collapse the display container 44 down to a much smaller configuration as shown in FIG. 5, can enable increased packaging density and reduced shipping costs.

Display containers such as the illustrated display containers 20 (FIGS. 1-4) and 44 (FIGS. 5-8) can be fabricated out of materials such as cardboard, paper board, and/or plastic, using a wide variety of manufacturing techniques including, but not limited to die cutting, molded plastic, stamping, perforating, etc.

The display containers of the invention may of course take numerous forms other than those shown in the illustrated examples. For example, in some embodiments, the display container may have only one rigidity flap per compartment. The rigidity flaps need not extend downward from the top panel; for example, they may extend backward from the front panel. In such a case, they may be held in place by the back panel. As another alternative example, the rigidity flaps may fold from outside edges of the top panel or front panel, instead of from the inside edges of top panel sections as shown. Many other variations are possible within the scope of the invention.

Figure 9:
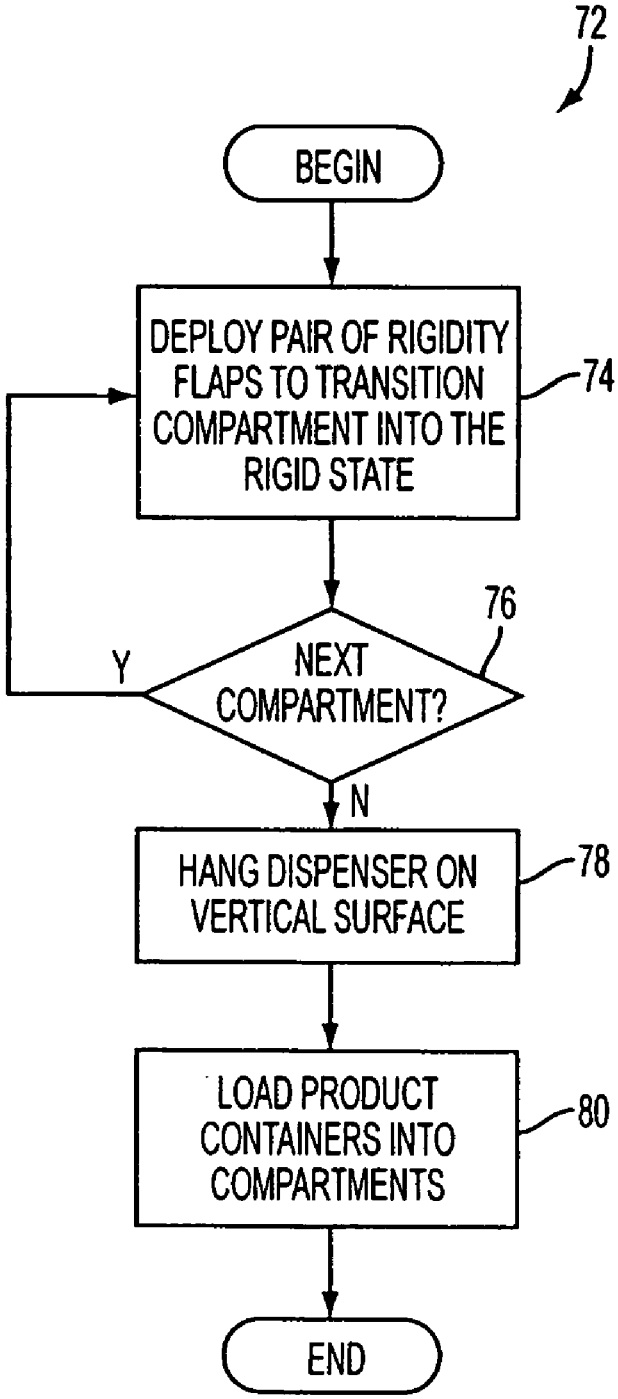
FIG. 9 is a flowchart of an example of a method of expanding a product display container according to an embodiment of the invention.

Turning now to FIG. 9, a method 72 of expanding a product display container is shown. In the illustrated example, processing block 74 provides for deploying a first pair of rigidity flaps to transition a first compartment in a plurality of compartments into a rigid state. The deploying of the rigidity flaps may be the sole mechanism for transitioning the compartment into the rigid state. The deploying may take place as described above. Other approaches to deploying the pairs of rigidity flaps may also be used.

Block 76 provides for determining whether all of the compartments of the display container have been transitioned into the rigid state. If not, block 74 can be repeated for each compartment in the display container. Otherwise, block 78 provides for hanging the display container on a vertical surface, which may involve the use of a hanging aperture disposed within a back panel of an uppermost one of the plurality of compartments. Products can then be loaded into the plurality of compartments at block 80.

The term "coupled" is used herein to refer to any connection, direct or indirect, and unless otherwise stated may include a mechanical, electrical, optical, electromagnetic, integral, separate, or other relationship between the components in question. Furthermore, any use of terms such as "first" and "second" do not necessarily infer a chronological relationship.

Although embodiments of the present invention have been disclosed in detail, it should be understood that various changes, substitutions, and alterations may be made herein, and the present invention is intended to cover various modifications and equivalent arrangements. Other examples are readily ascertainable from the above description by one skilled in the art and may be made without departing from the spirit and scope of the present invention as defined by the following claims.

What is claimed is:

1. A product display container comprising:

a plurality of compartments, each compartment in the plurality of compartments including at least:

(i) a bottom panel;

(ii) a front panel;

(iii) a back panel;

(iv) a bottom-front fold line between the bottom panel and the front panel; and (v) a bottom-back fold line between the bottom panel and the back panel;

wherein the product display container has a collapsed configuration in which the bottom panel is approximately parallel to the front and back panels and in which the front panel is proximate the back panel;

wherein the product display container has an expanded display configuration in which the front panel is spaced from the back panel and the bottom panel extends between the front and back panels to form an area for holding product to be displayed;

wherein each compartment in the plurality of compartments further comprises a rigidity flap;

wherein the rigidity flap is adapted to be deployed from a non-rigidifying position into a rigidifying position; and wherein, when the rigidity flap is in the rigidifying position, the rigidifying flap stiffens the product display container to resist compression from the expanded display configuration to the collapsed configuration.

2. The product display container of claim 1, wherein the rigidity flap is held in the rigidifying position by the bottom panel.

3. The product display container of claim 1, wherein the rigidity flap is held in the rigidifying position by an edge of the bottom panel.

4. The product display container of claim 1, wherein the rigidity flap is held in the rigidifying position by an opening in the bottom panel.

5. The product display container of claim 1, wherein the front panel has an inner surface that faces the area for holding product to be displayed;

wherein the back panel has an inner surface that faces the area for holding product to be displayed; and wherein, when the rigidity flap is in the rigidifying position, the rigidifying flap extends between the inner surface of the front panel and the inner surface of the back panel.

6. The product display container of claim 1, wherein the rigidity flap is adapted to be deployed from the non-rigidifying position into the rigidifying position by folding the rigidity flap at a fold line.

7. The product display container of claim 1, wherein each compartment in the plurality of compartments further comprises two rigidity flaps.

8. The product display container of claim 1, wherein each compartment in the plurality of compartments further comprises a top panel.

9. The product display container of claim 8, wherein the top panel comprises two top panel sections.

10. The product display container of claim 9, wherein each compartment in the plurality of compartments comprises two rigidity flaps, with one rigidity flap extending from and foldable with respect to one top panel section and the other rigidity flap extending from and foldable with respect to the other top panel section.

11. The product display container of claim 1, wherein the front panel includes a front compartment opening to facilitate access to a plurality of products disposed within the compartment.

12. The product display container of claim 1, wherein the back panel of one compartment is coupled to a front panel of an adjacent compartment.

13. The product display container of claim 1, further including a mounting mechanism coupled to an uppermost one of the plurality of compartments to enable the product display container to be hung.

14. The product display container of claim 1, wherein the product display container is adapted to be moved between the collapsed configuration and the expanded display configuration in an accordion-like manner.

15. A product display container comprising:

at least one compartment, the compartment including at least:

(i) a bottom panel;

(ii) a front panel;

(iii) a back panel;

(iv) a bottom-front fold line between the bottom panel and the front panel; and (v) a bottom-back fold line between the bottom panel and the back panel;

wherein the product display container has a collapsed configuration in which the bottom panel is approximately parallel to the front and back panels and in which the front panel is proximate the back panel;

wherein the product display container has an expanded display configuration in which the front panel is spaced from the back panel and the bottom panel extends between the front and back panels to form an area for holding product to be displayed;

wherein the compartment further comprises a rigidity flap;

wherein the rigidity flap is adapted to be deployed from a non-rigidifying position into a rigidifying position; and wherein, when the rigidity flap is in the rigidifying position, the rigidifying flap stiffens the product display container to resist compression from the expanded display configuration to the collapsed configuration.

* * * * *